US008640624B1

(12) United States Patent
Hassan et al.

(10) Patent No.: US 8,640,624 B1
(45) Date of Patent: Feb. 4, 2014

(54) LOW COLLATERAL DAMAGE AIR DEFENSE PROJECTILE

(75) Inventors: Ahmed Hassan, Summit, NJ (US); Marco Duca, Dover, NJ (US); Mohan Palathingal, Oradell, NJ (US); Daniel Vo, Landing, NJ (US); Anthony Vella, East Hanover, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/332,772

(22) Filed: Dec. 21, 2011

(51) Int. Cl.
*F42B 12/02* (2006.01)
*F42B 30/02* (2006.01)

(52) U.S. Cl.
USPC ..... 102/506; 102/439; 102/501; 102/517

(58) Field of Classification Search
USPC ..... 102/498, 501, 506, 517, 519, 529, 438, 102/439, 444
See application file for complete search history.

(56) References Cited

U.S. PATENT DOCUMENTS

| | | | | | |
|---|---|---|---|---|---|
| 3,800,706 | A * | 4/1974 | Gawlick et al. | ..... | 102/529 |
| 3,995,558 | A * | 12/1976 | Travor et al. | ..... | 102/519 |
| 4,128,060 | A * | 12/1978 | Gawlick et al. | ..... | 102/529 |
| 4,296,893 | A * | 10/1981 | Ballmann | ..... | 244/3.23 |
| 4,334,478 | A * | 6/1982 | Goes et al. | ..... | 102/529 |
| 4,393,783 | A * | 7/1983 | Goes et al. | ..... | 102/529 |
| 7,448,324 | B1 * | 11/2008 | King et al. | ..... | 102/517 |
| 7,806,053 | B1 * | 10/2010 | King et al. | ..... | 102/517 |
| 8,250,987 | B1 * | 8/2012 | Morley et al. | ..... | 102/506 |

* cited by examiner

*Primary Examiner* — James Bergin
(74) *Attorney, Agent, or Firm* — Michael C. Sachs

(57) ABSTRACT

A kinetic energy penetrator with a longitudinal axis may include a forward segment having a lateral surface, a rear surface, and at least one air bleed channel extending from the lateral surface to the rear surface. A second segment may be disposed aft of and torsionally engaged with the forward segment. The second segment may include a front surface adjacent the rear surface of the forward segment. The forward and second segments may each be asymmetric about the longitudinal axis of the penetrator. When the penetrator is in flight, bleed air through the bleed channels may impinge on the front surface of the second segment. The second segment may separate from the front segment. Kinetic energies of each of the forward and second segments may be less than about 75 joules upon impact with a ground surface.

13 Claims, 3 Drawing Sheets

LOW COLLATERAL DAMAGE AIR DEFENSE PROJECTILE

STATEMENT OF GOVERNMENT INTEREST

The inventions described herein may be manufactured, used and licensed by or for the U.S. Government for U.S. Government purposes.

BACKGROUND OF THE INVENTION

The invention relates in general to munitions and in particular to air defense projectiles.

In warfare, emphasis may be placed on the reduction of collateral damage. Collateral damage may include damage to infrastructure and injury or death of civilians. As battles move into urban environments, so do warfighters and their bases. Also, other urban interests may come under attack, such as, for example, embassies and consulates. Urban interests may require protection from incoming threats. But, it may be desired that the protection not destroy surrounding infrastructure or harm civilians in the area.

Kinetic energy penetrators may be effective in neutralizing incoming air borne threat munitions such as rockets, artillery and mortars. These penetrators may be monolithic cylindrical objects made from high density materials that maximize penetration. However, the high ballistic coefficient of these penetrators may pose a problem in urban environments. If the penetrators miss their intended target, the penetrators may have sufficient kinetic energy to cause collateral damage when they fall to the ground. This problem may restrict the use of otherwise effective air defense systems during urban operations. One solution has been the use of self-destructing high explosive munitions, which may detonate after a preset flight time. However, these munitions may have unreliable fuzes. Unreliable fuzes may cause unexploded ordinance (UXO) hazards and a high-probability of collateral damage.

A need exists for an air defense munition, such as a kinetic energy penetrator, that may create less collateral damage than known air defense munitions.

SUMMARY OF THE INVENTION

It is an object of the invention to provide a kinetic energy penetrator that may create less collateral damage than known air defense munitions.

One aspect of the invention is a kinetic energy penetrator having a longitudinal axis. The penetrator may include a forward segment and a second segment. The forward segment may have a lateral surface, a rear surface, and at least one air bleed channel extending from the lateral surface to the rear surface. The second segment may be disposed aft of and torsionally engaged with the forward segment. The second segment may include a front surface adjacent the rear surface of the forward segment. The forward and second segments may each be asymmetric about the longitudinal axis of the penetrator. When the penetrator is in flight, bleed air through the bleed channel may impinge on the front surface of the second segment. The second segment may separate from the front segment. Kinetic energies of each of the forward and second segments may be less than about 75 joules upon impact with the ground.

The second segment may include a lateral surface, a rear surface, and at least one bleed channel extending from the lateral surface to the rear surface. The penetrator may further include a third segment disposed aft of the second segment. The third segment may be torsionally engaged with the second segment. The third segment may include a front surface adjacent the rear surface of the second segment. The third segment may be asymmetric about the longitudinal axis of the penetrator. When the penetrator is in flight, bleed air through the bleed channel of the second segment may impinge on the front surface of the third segment. The third segment may separate from the second segment. A kinetic energy of the third segment may be less than about 75 joules upon impact with the ground.

One of the forward and second segments may include a shaft opening and the other of the forward and second segments may include a shaft disposed in the shaft opening. The shaft and the shaft opening may be keyed for torsional engagement of the forward and second segments.

One of the second and third segments may include a shaft opening and the other of the second and third segments may include a shaft disposed in the shaft opening. The shaft and the shaft opening may be keyed for torsional engagement of the second and third segments.

The penetrator may include no energetic material. The penetrator may include no electrically-operated components.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1A:
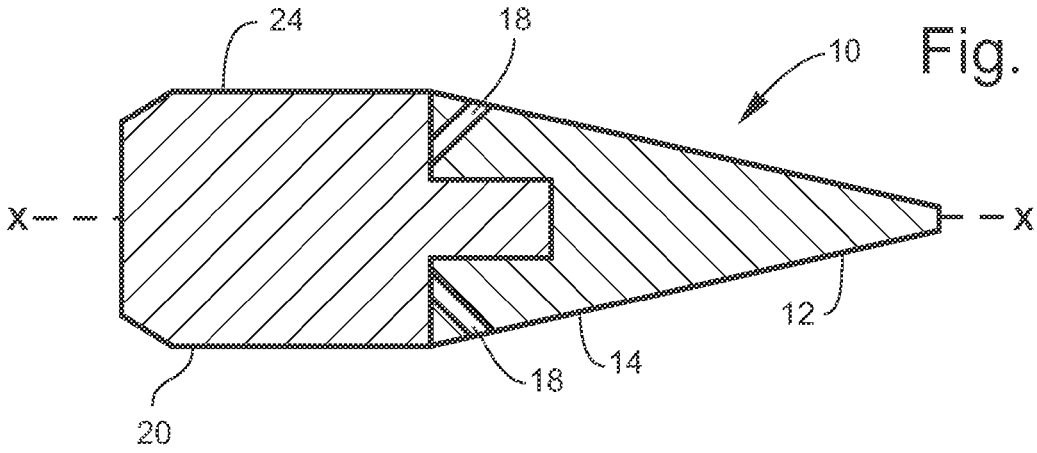
FIG. 1A is a longitudinal sectional view of one embodiment of a kinetic energy penetrator.
Figure 1B:
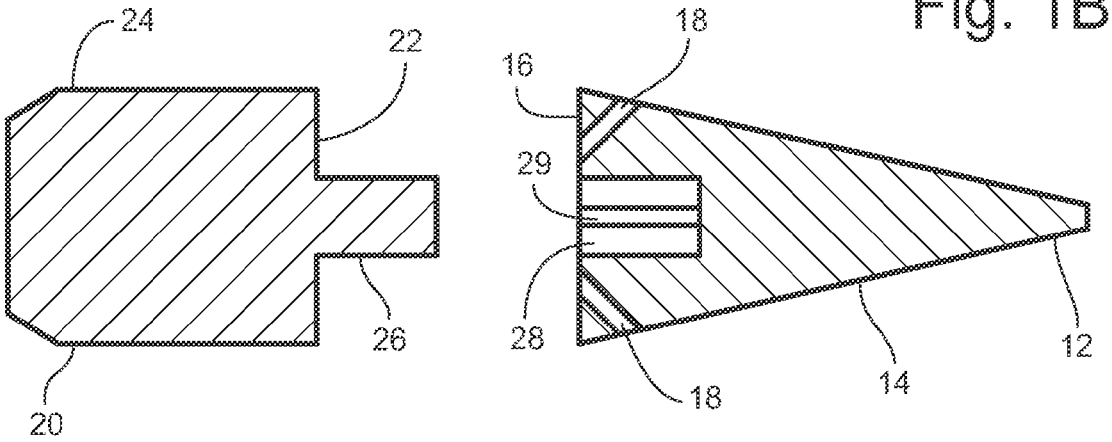
FIG. 1B is an exploded view of the penetrator of FIG. 1A.

FIG. 1A is a longitudinal sectional view of one embodiment of a kinetic energy penetrator 10 having a longitudinal axis XX. FIG. 1B is an exploded view of the penetrator 10 of FIG. 1A. Penetrator 10 may include a forward segment 12 having a lateral surface 14, a rear surface 16, and at least one air bleed channel 18 extending from lateral surface 14 to rear surface 16. Bleed channels 18 may have, for example, a circular cross-section. Bleed channels 18 may have, for example, a constant diameter. The central axes of bleed channels 18 may be, for example, straight lines. Forward segment 12 may be axially asymmetric about axis XX.

A second segment 20 may be disposed aft of and torsionally engaged with forward segment 12. Second segment 20 may include a front surface 22 adjacent rear surface 16 of forward segment 12. Second segment 20 may be asymmetric about longitudinal axis XX of penetrator 10. When penetrator 10 is in flight, bleed air through bleed channels 18 may impinge on front surface 22 of second segment 20. Second segment 20 may separate from front segment 12. Kinetic energies of each of forward and second segments 12, 20 may be less than about 75 joules upon impact with the ground.

Figure 1C:
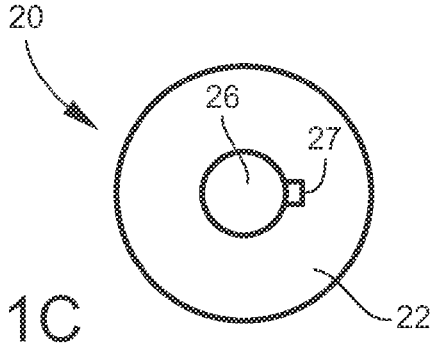
FIG. 1C is an end view of the second segment of FIG. 1A.

Forward segment 12 may include a shaft opening 28 and second segment 20 may include a shaft 26 disposed in shaft opening 28. Alternatively, forward segment 12 may include shaft 26 and second segment 20 may include shaft opening 28. Shaft 26 and shaft opening 28 may be keyed for torsional engagement of forward and second segments 12, 20. For example, in FIG. 1B, shaft opening 28 includes a female key slot 29 that may engage a male key 27 on shaft 26 (FIG. 1C). Alternatively, female key slot 29 may be formed in shaft 26 and male key 27 may be formed in shaft opening 28.

The lateral surface 14 of forward segment 12 may be generally conical. The lateral surface 24 of second segment 20 may be generally cylindrical. Forward and second segments 12, 20 may be made of, for example, heavy-metal materials, such as, for example, tungsten. Penetrator 10 may include no energetic material. Penetrator 10 may include no electrically-operated components.

In penetrator 10, the axial asymmetry of segment 12 may be the result of bleed holes 18 and shaft opening 28 with key slot 29. The axial asymmetry of segment 20 may be the result of shaft 26 with shaft key 27.

Figure 2A:
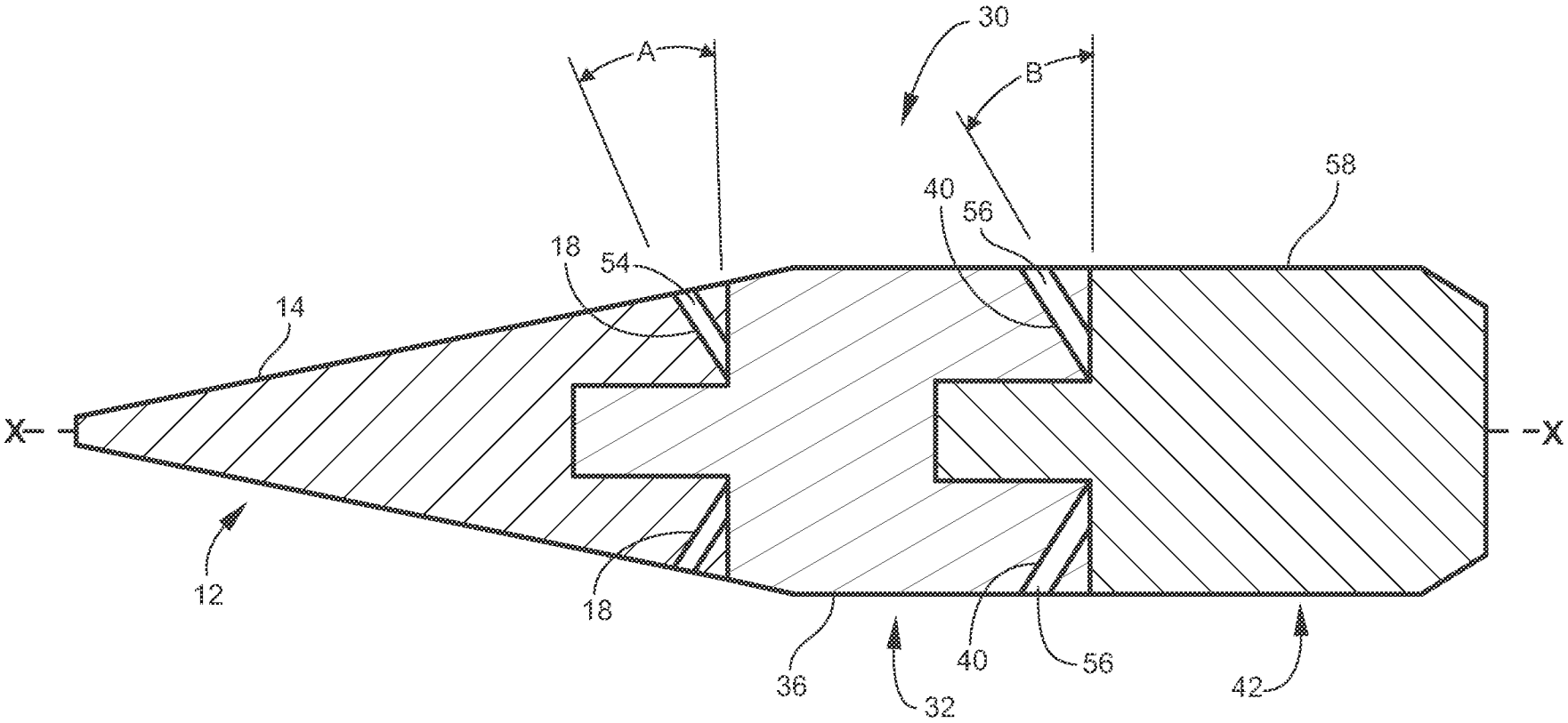
FIG. 2A is a longitudinal sectional view of another embodiment of a kinetic energy penetrator.
Figure 2B:
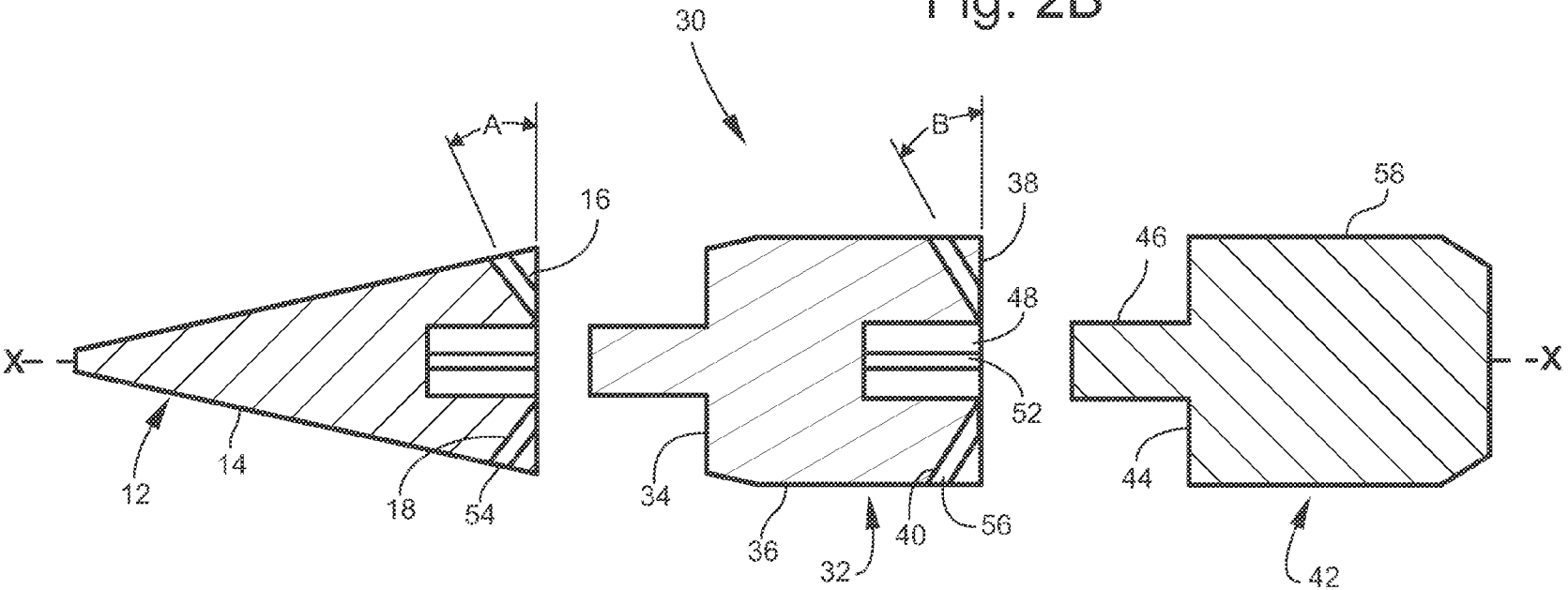
FIG. 2B is an exploded view of the penetrator of FIG. 2A.

FIG. 2A is a longitudinal sectional view of another embodiment of a kinetic energy penetrator 30 having a longitudinal axis XX. FIG. 2B is an exploded view of the penetrator 30 of FIG. 2A. Penetrator 30 may include a forward segment 12 as described with reference to penetrator 10. A second segment 32 may include a front surface 34, a lateral surface 36, a rear surface 38 and at least one bleed channel 40 extending from lateral surface 36 to rear surface 38. Bleed channels 40 may have, for example, a circular cross-section. Bleed channels 40 may have, for example, a constant diameter. The central axes of bleed channels 40 may be, for example, straight lines. Second segment 32 may be axially asymmetric about axis XX. Second segment 32 may be torsionally engaged with forward segment 12 similar to second segment 20 of penetrator 10.

Penetrator 30 may include a third segment 42 disposed aft of second segment 32. Third segment 42 may be torsionally engaged with second segment 32. Third segment 42 may include a front surface 44 adjacent rear surface 38 of second segment 32. Third segment 42 may be asymmetric about longitudinal axis XX of penetrator 30. When penetrator 30 is in flight, bleed air through bleed channels 40 of second segment 32 may impinge on front surface 44 of third segment 42. Third segment 42 may separate from second segment 32. The kinetic energy of third segment 42 may be less than about 75 joules upon impact with the ground surface.

Figure 2C:
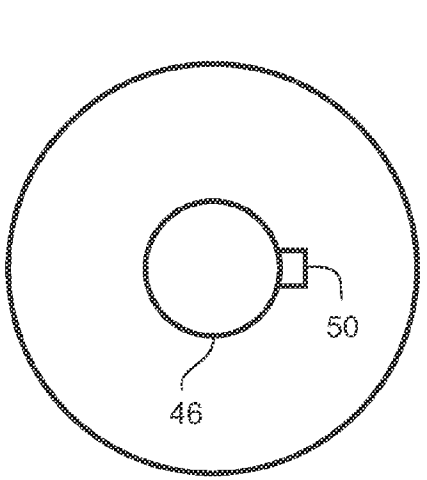
FIG. 2C is an end view of the third segment of FIG. 2A.

Second segment 32 may include a shaft opening 48 and third segment 42 may include a shaft 46 disposed in shaft opening 48. Alternatively, second segment 32 may include shaft 46 and third segment 42 may include shaft opening 48. Shaft 46 and shaft opening 48 may be keyed for torsional engagement of second and third segments 32, 42. For example, in FIG. 2B, shaft opening 48 includes a female key slot 52 that may engage a male key 50 on shaft 46 (FIG. 2C). Alternatively, female key slot 52 may be formed in shaft 46 and male key 50 may be formed in shaft opening 48.

Before, or, more likely, after third segment 42 separates from second segment 32, second segment 32 may separate from forward segment 12 as described with reference to penetrator 20. The kinetic energy of second segment 42 may be less than about 75 joules upon impact with the ground surface.

In penetrator 30, the axial asymmetry of segment 12 may be the result of bleed holes 18 and shaft opening 28 having key slot 29. The axial asymmetry of segment 32 may be the result of bleed holes 40, shaft 26 having shaft key 27, and shaft opening 48 having key slot 52. The axial asymmetry of segment 42 may be the result of shaft 46 having shaft key 50.

The lateral surface 14 of forward segment 12 may be generally conical. The lateral surfaces 36, 60 of second and third segments 32, 42 may be generally cylindrical. Forward, second, and third segments 12, 32, 42 may be made of, for example, heavy-metal materials, such as, for example, tungsten. Penetrator 30 may include no energetic material. Penetrator 30 may include no electrically-operated components.

In some embodiments of the penetrator, there may be more than three segments. The forward segment may have a generally conical or ogive shape. The other segments may be generally cylindrical in shape. However, if sufficiently asymmetrical, shapes other than generally cylindrical may also be used for the segments.

Penetrators 10, 30 may have a medium caliber, for example, about 20 mm to about 60 mm. Penetrators 10, 30 may be customized so that the segments separate from each other at a specific distance from a protected area. A protected area is an area where collateral damage from the penetrator may be minimized or eliminated. In general, when the number of bleed holes 18, 40 in each segment increases, the range (from firing or launching point) at which the penetrator falls apart may be less. In general, when the diameter of bleed holes 18, 40 is increased, the range at which the penetrator falls apart may also be less. More and/or larger bleed holes 18, 40 may cause the bled-in high pressure air to act on a larger area of front surfaces 22, 34, 44 of segments 20, 32, 42, respectively, thereby increasing the net force tending to separate the segments.

Similarly, as the angles A and B (FIG. 2A) decrease, the effective high pressure area on front surfaces 34, 44 of segments 32, 42 may increase. So, as angles A and B decrease, the range at which the segments separate may be less. And, the location of the entrance holes 54, 56 of channels 18, 40 may be related to the bled-in air pressure. Higher or lower air pressure may flow through channels 18, 40 because the pressure distribution on penetrator 30 may not be constant. At any instant in flight, penetrator 30 may have a distributed pressure load over its surface. If the surface pressure bled into channels 18, 40 is low, penetrator 30 may fly a longer distance before the segments separate. If the surface pressure bled into channels 18, 40 is high, penetrator 30 may fly a shorter distance before the segments separate.

The mass of third segment 42 may influence the time of flight or distance at which penetrator 30 disintegrates. For a given set of loading conditions over time, a larger mass of segment 42 may increase flight time or distance prior to disintegration. Second segment 32 may separate later than third segment 42.

The segmented penetrator may reduce or eliminate collateral damage. Because no energetic material may be present in the penetrator, the problem of unexploded ordnance is eliminated. Furthermore, no electrical components or electronics may be required in the penetrator. The distance or range to separation of the segments may be varied by adjusting the design variables of the segments.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A kinetic energy penetrator having a longitudinal axis, said penetrator including no energetic material, the penetrator further comprising:

a forward segment having a lateral surface, a rear surface, and at least one air bleed channel extending from the lateral surface to the rear surface;

a second segment disposed aft of and torsionally engaged with the forward segment, the second segment including a front surface adjacent the rear surface of the forward segment;

the forward and second segments each being asymmetric about the longitudinal axis of the penetrator;

wherein, when the penetrator is in flight, the emergence of impinging air flow will bleed air through the at least one air bleed channel and with such bled air flow on the front surface of the second segment, the second segment separates from the front segment, and kinetic energies of each of the forward and second segments are less than about 75 joules upon impact with a ground surface, and;

wherein the second segment includes a lateral surface, a rear surface, and at least one bleed channel extending from the lateral surface to the rear surface, the penetrator further comprising a third segment disposed aft of the second segment, the third segment being torsionally engaged with the second segment, the third segment including a front surface adjacent the rear surface of the second segment, the third segment being asymmetric about the longitudinal axis of the penetrator, wherein, when the penetrator is in flight, the emergence of impinging air flow will bleed air through the at least one bleed channel of the second segment and with such bled air flow on the front surface of the third segment, the third segment separates from the second segment, and a kinetic energy of the third segment is less than about 75 joules upon impact with the ground surface.

2. The penetrator of claim 1, wherein one of the second and third segments includes a shaft opening and the other of the second and third segments includes a shaft disposed in the shaft opening and further wherein the shaft and the opening are keyed for torsional engagement of the second and third segments.

3. The penetrator of claim 2, wherein the lateral surface of the forward segment is generally conical and the lateral surfaces of the second and third segments are generally cylindrical.

4. The penetrator of claim 1, wherein the forward segment includes a plurality of air bleed channels extending from the lateral surface to the rear surface.

5. A kinetic energy penetrator having a longitudinal axis, the penetrator comprising:

a forward segment having a lateral surface, a rear surface, and at least one air bleed channel extending from the lateral surface to the rear surface;

a second segment having a front surface, a lateral surface, a rear surface and at least one air bleed channel extending from the lateral surface to the rear surface, the second segment being torsionally engaged with the forward segment, the front surface of the second segment being adjacent the rear surface of the forward segment;

a third segment having a front surface, the third segment being torsionally engaged with the second segment, the front surface of the third segment being adjacent the rear surface of the second segment;

the forward, second and third segments each being asymmetric about the longitudinal axis of the penetrator;

wherein, when the penetrator is in flight, the emergence of impinging air flow will bleed air through the at least one air bleed channel of said second segment and with such bled air flow on the front surface of the third segment, the third segment separates from the second segment, and impinging air also bled through the at least one air bleed channel of said forward segment impinges on the front surface of the second segment and the second segment also separates from the forward segment, and;

wherein kinetic energies of each of the forward, second and third segments are less than about 75 joules upon impact with a ground surface.

6. The penetrator of claim 5, wherein the penetrator includes no energetic material.

7. The penetrator of claim 6, wherein the penetrator includes no electrically-operated components.

8. The penetrator of claim 7, wherein the forward, second and third segments are made of heavy-metal materials.

9. The penetrator of claim 7, wherein the respective air bleed channels of the forward and second segments are constant diameter, circular cross-section channels with central axes that are straight lines.

10. The penetrator of claim 5, wherein one of the forward and second segments includes a shaft opening and the other of the forward and second segments includes a shaft disposed in the shaft opening and further wherein the shaft and the opening are keyed for torsional engagement of the forward and second segments.

11. The penetrator of claim 10, wherein one of the second and third segments includes a second shaft opening and the other of the second and third segments includes a second shaft disposed in the second shaft opening and further wherein the second shaft and the second opening are keyed for torsional engagement of the second and third segments.

12. The penetrator of claim 10, wherein the forward segment includes a plurality of air bleed channels extending from the lateral surface to the rear surface.

13. The penetrator of claim 12, wherein the lateral surface of the forward segment is generally conical and the lateral surfaces of the second and third segments are generally cylindrical.

* * * * *